US010577817B2

(12) United States Patent
Cieslar

(10) Patent No.: US 10,577,817 B2
(45) Date of Patent: Mar. 3, 2020

(54) SWIMMING POOL WALL HAVING A DRAINAGE GROOVE

(71) Applicant: BERNDORF BADERBAU s.r.o., Bystrice nad Olsi (CZ)

(72) Inventor: Rudolf Cieslar, Milikov u Jablunkova (CZ)

(73) Assignee: BERNDORF BADERBAU S.R.O., Bystrice nad Olsi (CZ)

( * ) Notice: Subject to any disclaimer, the term of this patent is extended or adjusted under 35 U.S.C. 154(b) by 0 days.

(21) Appl. No.: 16/053,986

(22) Filed: Aug. 3, 2018

(65) Prior Publication Data

US 2019/0063095 A1 Feb. 28, 2019

(30) Foreign Application Priority Data

Aug. 28, 2017 (CZ) ..... PUV 2017-34051

(51) Int. Cl.
*E04H 4/12* (2006.01)

(52) U.S. Cl.
CPC ..... *E04H 4/12* (2013.01); *E04H 4/1227* (2013.01)

(58) Field of Classification Search
CPC ..... E04H 4/12
USPC ..... 4/507
See application file for complete search history.

(56) References Cited

U.S. PATENT DOCUMENTS 4,462,125 A * 7/1984 Jakowicki ..... E04H 4/00 4/507

* cited by examiner

*Primary Examiner* — Lori L Baker
(74) *Attorney, Agent, or Firm* — Ladas & Parry LLP

(57) ABSTRACT

A swimming pool wall having a drainage groove. The side wall (2) of the swimming pool and the drainage groove (10) are formed from a single piece of material. The slope wall (4) of the drainage groove (10), which is linked to the side wall (2) of the swimming pool, directly adjoins the swimming pool overflow edge (3).

20 Claims, 2 Drawing Sheets

SWIMMING POOL WALL HAVING A DRAINAGE GROOVE

TECHNICAL FIELD

This invention relates to a swimming pool wall having a drainage groove which is made of a single piece of material, and which is intended especially for relaxation and children's swimming pools where higher water temperature and high hygienic standard are required, especially for bathing, relaxation and relaxation pools and swimming pools for bathing children or for swimming pools for sanitary use.

BACKGROUND ART

Currently, requirements for a higher hygiene standard for all types of swimming pools are increasing, especially in connection with the increasing sensitivity of users to allergies, chemical water treatment and the use of skin care products by users. For these reasons, stainless steel swimming pools with a high standard of hygiene are produced for these purposes, but their production is technically difficult and therefore costly.

An example may be a technical solution according to European Patent EP 899 397. In this case, the pool wall is made of one piece of material and the adjacent drainage groove is produced separately. Subsequently, these two relatively dimensional parts must be combined. The connection is preferably realized by welding, but the welding of stainless steel is difficult and costly.

The transition between the swimming pool wall and the wall of the drainage groove is realized by a special transition wall, rising upwards to the crown or an overflowing edge of the swimming pool. For the convenience of swimmers and pool users, this wall is provided with a groove, the creation of which represents another technological operation. After overtaking the pool crown, the wall slopes to the vertical line at an acute angle of about 12 degrees downward to be connected in this part with another piece that provides a drainage groove for overflowing water over the swimming pool crown and is important for circulating and purifying water in the swimming pool.

The actual drain groove is provided with a cover grid that allows water to drain and is attached to the top of the drainage groove obliquely so that it does not extend to the pool wall, thereby creating a gripping space for swimmers or other pool users between the end of the oblique cover and the swimming pool wall.

This embodiment of the swimming pool wall and drainage groove requires a demanding welding process of the stainless steel from which both parts, i.e. the wall and the drainage groove, are manufactured with increasing frequency at the request of customers.

Also the transition between the pool wall and the drain wall is complicated from a technical point of view. Similarly, the mounting of drainage grid covers is technically demanding. All these drawbacks lead to increased swimming pool costs and the occurrence of deformations at the welding site, as well as to the permanent risk of leakage of the weld joint.

SUMMARY OF THE INVENTION

Said drawbacks of the prior art are to a large extent eliminated by a technical solution of a swimming pool wall with a drainage groove, where both the side wall of the pool and the drainage channel are formed from a single piece, wherein the slope wall the drainage groove adjacent to the side wall of the swimming pool directly adjoins the swimming pool overflow edge.

The distant second vertical wall of the drainage groove adjoins the horizontal portion of the drainage groove which forms the second support for the grid attachment, and can be optimally terminated by a horizontal edge having a vertical crimp.

The side wall of the drainage groove adjacent to the pool wall can directly join the overflow edge of the swimming pool wall by means of a single bend, wherein the slope wall of the drainage channel and the swimming pool side wall form an angle greater than 20 degrees.

The first vertical wall of the drainage groove or optionally the slope wall of the drainage groove may be provided with a horizontal part for attaching the grid of the drainage groove.

The drainage groove grid is supported by a continuous horizontal counter element, which is connected to a horizontal rib connecting the side wall of the swimming pool and the first vertical wall of the drainage groove.

This technical solution is simple, requires no joining of the stainless steel parts and enables an easy and simple mounting of the drainage groove cover grids. All these technical measures lead to cost savings, increase the swimming pool impermeability and accelerate their construction.

In addition, the above-mentioned technical solution reduces the sound of falling water into the overflow groove, while allowing swimming pool users a safe grip.

Another beneficial technical effect of this technical solution consists in allowing a better cover of the swimming pool water surface by a cover shutter, as it allows to cover the whole water surface of the swimming pool. This reduces the energy losses caused by evaporation.

BRIEF DESCRIPTION OF THE DRAWINGS

A swimming pool wall having a drainage groove according to the invention is shown schematically in a cross-section in the accompanying drawing, in which.

DETAILED DESCRIPTION OF THE INVENTION

Exemplary Embodiment Number 1

Figure 1:
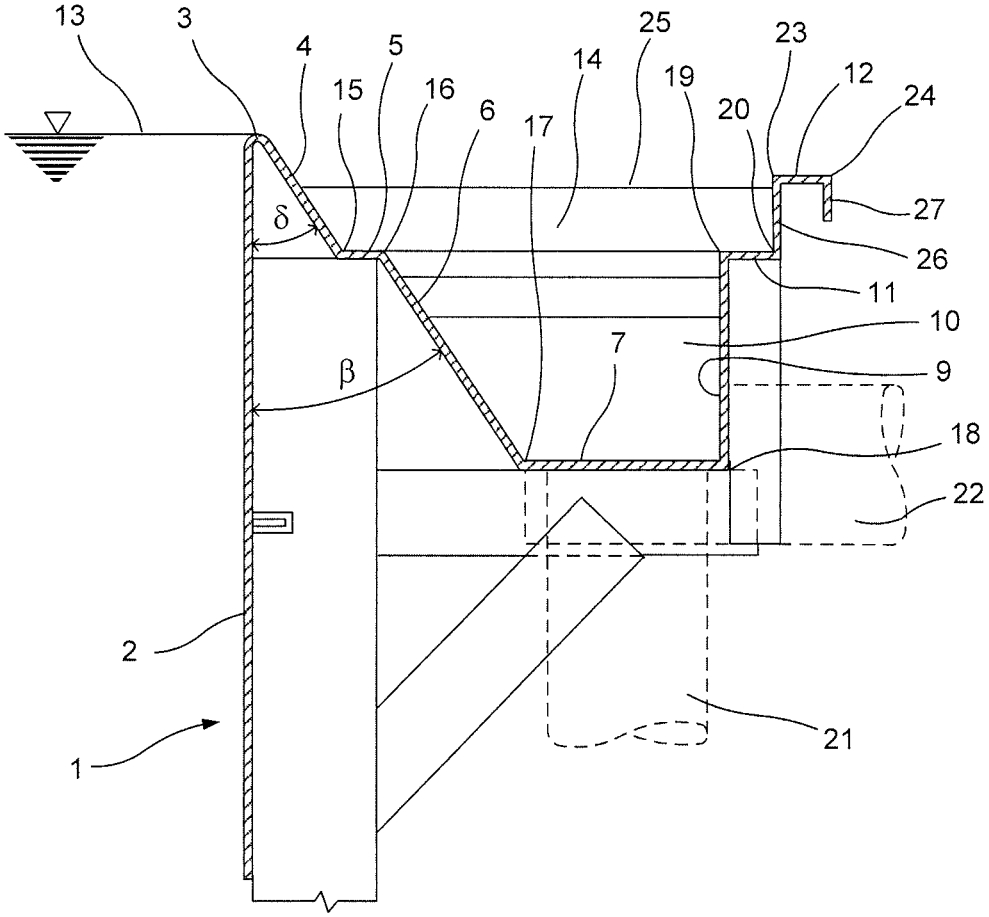
FIG. 1 is a schematic sectional view of the swimming pool profiled wall made of one piece of a metal plate shaped by mechanical shaping, the groove being provided with two L profiles that create supports for the attachment of the grid.

FIG. 1 shows a profile of a swimming pool wall with an overflow edge and a groove which in the direction 1 shows a sectional view of the profiled swimming pool wall made of a one piece of a metal plate shaped by mechanical shaping, the groove 10 being provided with two L profiles which form the support for the attachment of the grid 14.

The outer jacket of the pool is engineered as a mechanically shaped wall made of a single piece of a stainless steel plate.

The vertical side wall 2 of the swimming pool forms by means of a bend at an acute angle δ with the slope wall 4 an overflow edge 3 for the swimming pool water level 13.

The slope wall 4 can be in the vertical plane higher than the upper portion 35 of the grid 14 by at least 15 mm, as measured vertically, to form a safety grip according to the safety standard.

The slope wall 4 extends in the form of a beveled L profile with a first bend 15 at an obtuse angle 90°+δ in the horizontal direction, where it forms the first support 5 for attaching the grid 14. By forming the slope wall 4 into the second bend 16, again at the angle δ or the angle β which is different from the previous angle δ, a lower part 6 of the slope wall 4 extends continuously to the third bend 17 which forms a front part of the bottom 7 of the groove 10 and furthermore it extends substantially horizontally to the fourth bend 18 where it is further directed at right angle upwards to form the first vertical wall 9 of the groove 10.

The first vertical wall 9 is terminated in its upper part end by the fifth bend 19 which extends at right angle to form a horizontal portion 11 of the groove wall 10 representing the second support of the grid 14. The horizontal part 11 of the groove 10 continues by means of the sixth bend 20 at an angle of 90° upwardly to form the second vertical wall 26 of the groove 10 which forms by means of the seventh bend 23 under the angle 90° a horizontal edge 12 which terminates—again at right angle—downwards by means of the eighth bend 24 a vertical edge 27 of the swimming pool groove 10.

The swimming pool groove 10 serves to catch the overflowing water level 13 over the overflow edge 3 of the swimming pool and furthermore it serves to accumulate the floating water level 13 for smooth flowing from the whole of the swimming pool groove 10 into individual vertical outlets 21 and horizontal outlets 22 respectively.

The swimming pool groove 10 is from above covered by the grid 14, which fulfils the function of a safety cover. The grid 14 is perforated so as to further ensure the penetration of overflow pool water over the overflow edge 3 of the swimming pool. At the top part, the grid 14 is provided with an anti-slip surface treatment.

The supporting steel structure which is formed by an inclined support beam 8, a first vertical support beam 30 of the swimming pool, a horizontal support beam 31 and a second vertical support beam 32 provide the static conditions against the deformation and collapse of the swimming pool side wall 2 and the swimming pool groove wall 10.

The beams 8, 30, 31, 32, mutually close-connected for example by welding into a rigid structure, are spaced apart at the perimeter of the swimming pool in vertical spacing corresponding to the static calculation of the swimming pool side walls 2 including the groove 10 and are respectively to the swimming pool side wall 2 and the groove 10 anchored by a fixed connection, for example by welding.

The overflow edge 3, the bends 15, 16, 17, 18, 19, 20, 23 and 24, the swimming pool parts 2, 4, 6, 9, 11 and 26 and the first support 5, the bottom 7, the horizontal edge 12 and the vertical crimp 27 are made by forming a single piece of a metal plate. The lower portion of the slope wall 6 and the first vertical wall 9 of the groove 10 are statically reinforced by welded horizontal ribs 28.

With the bottom 7 of the groove 10, a vertical outlet 21 from the groove 10 is connected, for example by welding. A horizontal outlet 22 of the groove 10 may be also realized by inserting into the first vertical wall 9 of the groove 10 and the bottom 7, for example by welding.

Exemplary Embodiment Number 2

Figure 2:
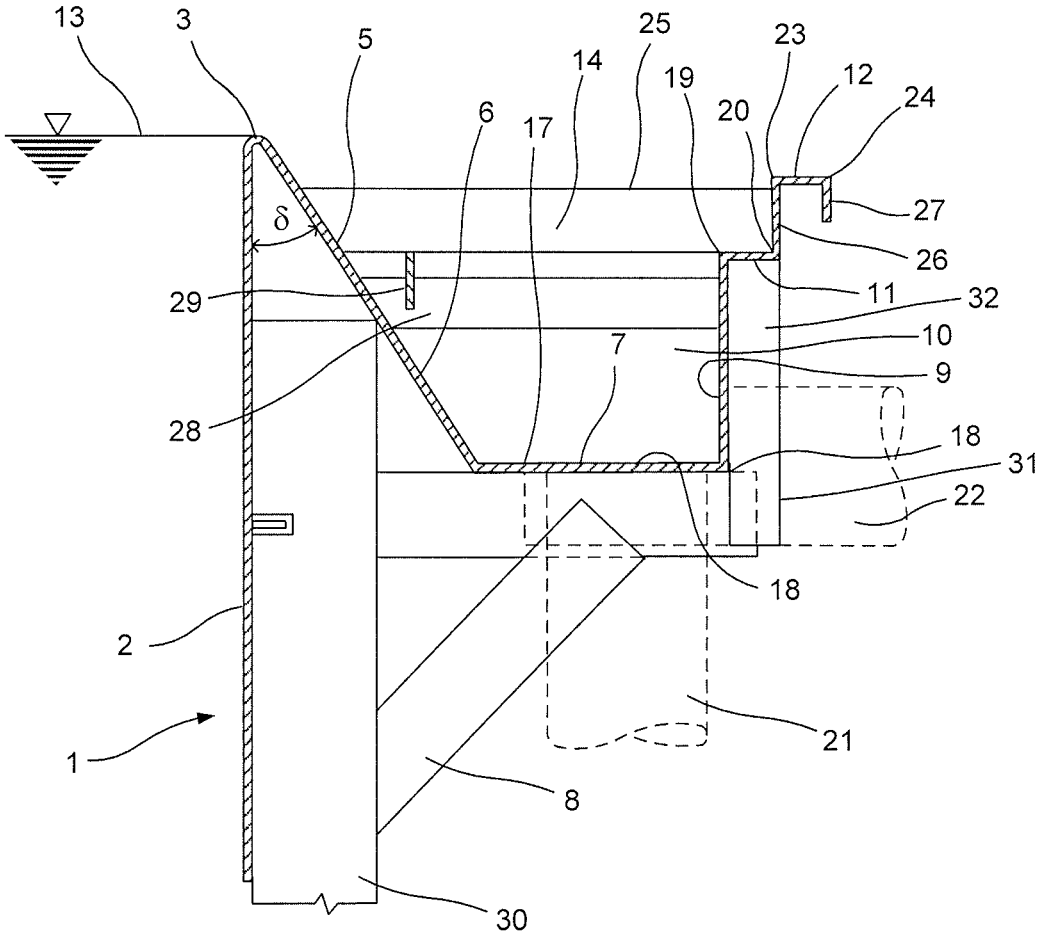
FIG. 2 is a schematic sectional view of a profiled swimming pool wall made of a one piece of a metal plate shaped by mechanical shaping, the groove being provided with only one single L profile which forms one support for the grid placement and the second grid support is a horizontal rib with a welded continuous counter element.

FIG. 2 represents a profile of the swimming pool wall with an overflow edge and a groove and shows in the direction 1 in a sectional view the profiled pool wall made of a one piece of a metal plate shaped by mechanical shaping, the groove 10 being provided with only one L profile which forms one support for attaching the grid 14, and the second grid support being represented by a horizontal rib 28 with a continuously welded horizontal counter element 29.

The outer jacket of the pool is engineered as a mechanically shaped wall made of a single piece of a stainless steel plate. The vertical side wall 2 of the swimming pool forms by means of a bend at an acute angle δ with the slope wall 4 an overflow edge 3 for the swimming pool water level 13. The slope wall 4 can be in the vertical plane higher than the upper portion 35 of the grid 14 by at least 15 mm, as measured vertically, to form a safety grip according to the safety standard.

The slope wall 4 continues at an angle δ towards the horizontal rib 28 equipped with a welded horizontal counter element 29, wherein the counter element 29 forms the first horizontal support for attaching the grid 14.

The horizontal counter element 29 is continuous along the entire length of the pool and is welded to horizontal ribs 28 which are distributed with the spacing about 30 to 50 cm across the perimeter of the pool.

The slope wall 4 extends continuously at an angle δ to the third bend 17 which forms a front end of the bottom 7 of the groove 10 and continues further substantially horizontally to the fourth bend 18 where it further extends at a right angle upwardly, thus creating a first vertical wall 9 of the groove 10.

The first vertical wall 9 is terminated in its upper part ends by the fifth bend 19 which extends at right angle to form a horizontal portion 11 of the groove wall 10 representing the second support of the grid 14. The horizontal part 11 of the groove 10 continues by the sixth bend 20 at an angle of 90° upwardly to form the second vertical wall 26 of the groove 10 which forms by means of the seventh bend 23 under the angle 90° a horizontal edge 12 which terminates—again at right angle—downwards by means of the eighth bend 24 a vertical edge 27 of the swimming pool groove 10.

The overflow edge 3, the bends 15, 16, 17, 18, 19, 20, 23 and 24, the swimming pool parts 2, 4, 6, 9, 11 and 26 and the first support 5, the bottom 7, the horizontal edge 12 and the vertical crimp 27 are made by forming a single piece of a metal plate. The lower portion of the slope wall 6 and the first vertical wall 9 of the groove 10 are statically reinforced by welded horizontal ribs 28.

With the bottom 7 of the groove 10, a vertical outlet 21 from the groove 10 is connected, for example by welding. A horizontal outlet 22 of the groove 10 may be also realized by inserting into the first vertical wall 9 of the groove 10 and the bottom 7, for example by welding.

INDUSTRIAL APPLICABILITY

The technical solution of a swimming pool wall with a drainage groove which is made of a single piece of material and which is intended especially for relaxation and children's swimming pools where a higher water temperature and high hygienic standard are required, especially for bathing, relaxation and relaxation pools and swimming pools for bathing children or for swimming pools for sanitary use.

LIST OF REFERENCE NUMERALS

1. direction
2. side wall

3. overflow edge
4. slope wall
5. first support
6. lower part of the slope wall
7. bottom
8. inclined support beam
9. first vertical wall
10. groove
11. horizontal part
12. horizontal edge
13. water surface
14. grid
15. first bend
16. second bend
17. third bend
18. fourth bend
19. fifth bend
20. sixth bend
21. vertical outlet
22. horizontal outlet
23. seventh bend
24. eighth bend
25. upper part
26. second vertical wall
27. vertical crimp
28. horizontal rib
29. horizontal counter element
30. first vertical beam
31. horizontal support beam
32. second vertical support beam

The invention claimed is:

1. A structural member for a swimming pool comprising a single piece of material, the single piece of material comprising:

(a) first means for serving as a side wall of the swimming pool and for defining an overflow edge of the swimming pool, and (b) second means for defining a drainage groove for receiving water from the swimming pool that overflows the overflow edge defined by the first means with the first means serving as a side wall of the swimming pool; wherein the second means comprises a connecting portion that is integrally formed with the first means and that extends from the overflow edge defined by the first means.

2. The structural member according to claim 1, wherein the connecting portion of the second means extends from the overflow edge defined by the first means at an acute angle to below the overflow edge, the connecting portion having a zig-zag profile comprising a first sloped section, a first horizontal section extending from a bottom end of the first sloped section away from the first means, a second sloped section extending from a distal end of the first horizontal section to below the first horizontal section, and a second horizontal section extending from a bottom end of the second sloped section away from the first means.

3. The structural member according to claim 2, wherein the second means further comprises a first vertical portion that extends from a distal end of the second horizontal section above the second horizontal section.

4. The structural member according to claim 3, wherein the second means further comprises a second vertical portion and a first horizontal portion, the first horizontal portion being integrally formed with both the first vertical portion and the second vertical portion and connecting a top of the first vertical portion with a bottom of the second vertical portion and extending away from the first means, the first horizontal part of the connecting portion and the first horizontal portion together forming means for supporting respective first and second ends of a grid attachment for the drainage groove.

5. The structural member according to claim 4, wherein the second means further comprises (i) a second horizontal portion extending from a top end of the third vertical portion and away from the first means and (ii) a vertical crimp extending from and below a distal end of the second horizontal portion.

6. The structural member according to claim 4, wherein the first horizontal section extends from the bottom end of the first sloped section at an obtuse angle and the second horizontal section extends from the bottom end of the second sloped section at an obtuse angle.

7. The structural member according to claim 1, wherein the connecting portion of the second means extends from the overflow edge defined by the first means at an acute angle to below the overflow edge and wherein the connecting portion has a generally L-shape profile comprising a first sloped section and a first horizontal section extending from a bottom end of the first sloped section away from the first means.

8. The structural member according to claim 6, wherein the second means comprises a first vertical portion that extends from a distal end of the first horizontal section and above the first horizontal section.

9. The structural member according to claim 7, wherein the second means further comprises a first vertical portion that extends from a distal end of the first horizontal section and above the first horizontal section.

10. The structural member according to claim 8, wherein the second means further comprises a second vertical portion and a first horizontal portion, the first horizontal portion being integrally formed with both the first vertical portion and the second vertical portion and connecting a top end of the first vertical portion with a bottom end of the second vertical portion and extending away from the first means, the first horizontal portion forming means for supporting an end of a grid attachment for the drainage groove.

11. The structural member according to claim 9, wherein the second means further comprises (i) a third vertical portion extending from and above a distal end of the first horizontal portion, (ii) a second horizontal portion extending from a top end of the third vertical portion and away from the first means and (iii) a vertical crimp extending from and below a distal end of the third horizontal portion.

12. The structural member according to claim 7, wherein the first horizontal section extends from the bottom end of the first sloped section at an obtuse angle.

13. The structural member according to claim 2, wherein the first sloped section forms an angle of greater than 20 degrees with the first means.

14. The structural member according to claim 7, wherein the first sloped section forms an angle of greater than 20 degrees with the first means.

15. An apparatus comprising the structural member according to claim 4 and the grid attachment for the drainage groove.

16. An apparatus comprising the structural member according to claim 7 and a horizontal rib connecting the first means and the first vertical portion.

17. An apparatus according to claim 15, further comprising a continuous horizontal counter element connected to the horizontal rib.

18. A swimming pool comprising the structural member according to claim 1.

19. A swimming pool comprising the structural member according to claim 2.

20. A swimming pool comprising the structural member according to claim 7.

* * * * *